US007498540B2

(12) United States Patent
Yoshitomo

(10) Patent No.: US 7,498,540 B2
(45) Date of Patent: Mar. 3, 2009

(54) GAS-BLAST CIRCUIT BREAKER

(75) Inventor: Yuji Yoshitomo, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 226 days.

(21) Appl. No.: 11/444,332

(22) Filed: Jun. 1, 2006

(65) Prior Publication Data

US 2006/0279385 A1 Dec. 14, 2006

(30) Foreign Application Priority Data

Jun. 1, 2005 (JP) ..... 2005-160878

(51) Int. Cl.
*H01H 33/70* (2006.01)

(52) U.S. Cl. ..... 218/46; 218/43; 218/154

(58) Field of Classification Search ..... 218/2, 218/7, 13, 14, 43–52.55, 58, 59, 68–71, 78, 218/79, 84, 153, 154
See application file for complete search history.

(56) References Cited

U.S. PATENT DOCUMENTS 3,941,963 A * 3/1976 Sasaki et al. ..... 218/63
4,749,831 A * 6/1988 Hosomi et al. ..... 218/57
5,387,773 A * 2/1995 Nakajima et al. ..... 218/61
6,621,030 B2 * 9/2003 Andou et al. ..... 218/43
6,624,370 B1 * 9/2003 Soga ..... 218/43

FOREIGN PATENT DOCUMENTS

JP 64-10939 U 1/1989
JP 6-096644 4/1994
JP 8-115642 5/1996

* cited by examiner

*Primary Examiner*—Elvin G Enad
*Assistant Examiner*—Marina Fishman
(74) *Attorney, Agent, or Firm*—Buchanan Ingersoll & Rooney PC

(57) ABSTRACT

The gas-blast circuit breaker includes an electrically conductive vessel charged with insulating gases and kept at earth potential, a stationary arc-extinguishing chamber accommodated in a ground metal tank and corresponding to a moving part to extinguish an arc generated between it and the moving part, an insulating member that supports the stationary arc-extinguishing chamber to insulate the same from an earth potential portion, an opening provided on the ground metal tank, and a lid body that closes the opening provided on the ground metal tank and is arranged detachably on the opening from outside the ground metal tank, and one end of the insulating member is mounted to a mount provided on the lid body, and therefore a gas-blast circuit breaker is obtained to enable ensuring a sufficient insulation distance and appropriately and easily performing working of and a mount work of mount portions of an insulating member.

4 Claims, 2 Drawing Sheets

GAS-BLAST CIRCUIT BREAKER

BACKGROUND OF THE INVENTION

1. Field of the Invention

The present invention relates to a gas-blast circuit breaker, and more particular, to a gas-blast circuit breaker, in which a stationary arc-extinguishing chamber is supported through an insulator on a ground.

2. Description of the Related Art

In a gas-blast circuit breaker, in which a stationary arc-extinguishing chamber is supported through an insulating member on a ground, the insulating member, which insulatingly supports the stationary arc-extinguishing chamber, according to the related art is mounted to a boss member protrusively provided in a ground tank to be made integral therewith (for example, see JP-A-6-96644).

Such related art involves a problem that the boss member protrusively provided in the inside of the ground tank makes it impossible to ensure a sufficient insulation distance, working of a mount surface of the boss member to which the insulating member is mounted is difficult, and a mount work becomes troublesome.

SUMMARY OF THE INVENTION

The invention is directed to obtaining a gas-blast circuit breaker, which can ensure a sufficient insulation distance and appropriately and easily perform working of and a mount work of an insulating member.

A gas-blast circuit breaker according to the invention comprises an electrically conductive vessel charged with insulating gases and kept at earth potential, a stationary arc-extinguishing chamber accommodated in the electrically conductive vessel and corresponding to a moving part to extinguish an arc generated between it and the moving part, an insulating member that supports the stationary arc-extinguishing chamber to insulate the same from an earth potential portion, an opening provided on the electrically conductive vessel, and a lid body that closes the opening provided on the electrically conductive vessel and is arranged detachably on the opening, and one end of the insulating member is mounted to a mount provided on the lid body.

According to the invention, it is possible to obtain a gas-blast circuit breaker, which can ensure a sufficient insulation distance and appropriately and easily perform working of and a mount work of mount portions of an insulating member.

DESCRIPTION OF THE PREFERRED EMBODIMENT

Embodiment 1

Figure 1:
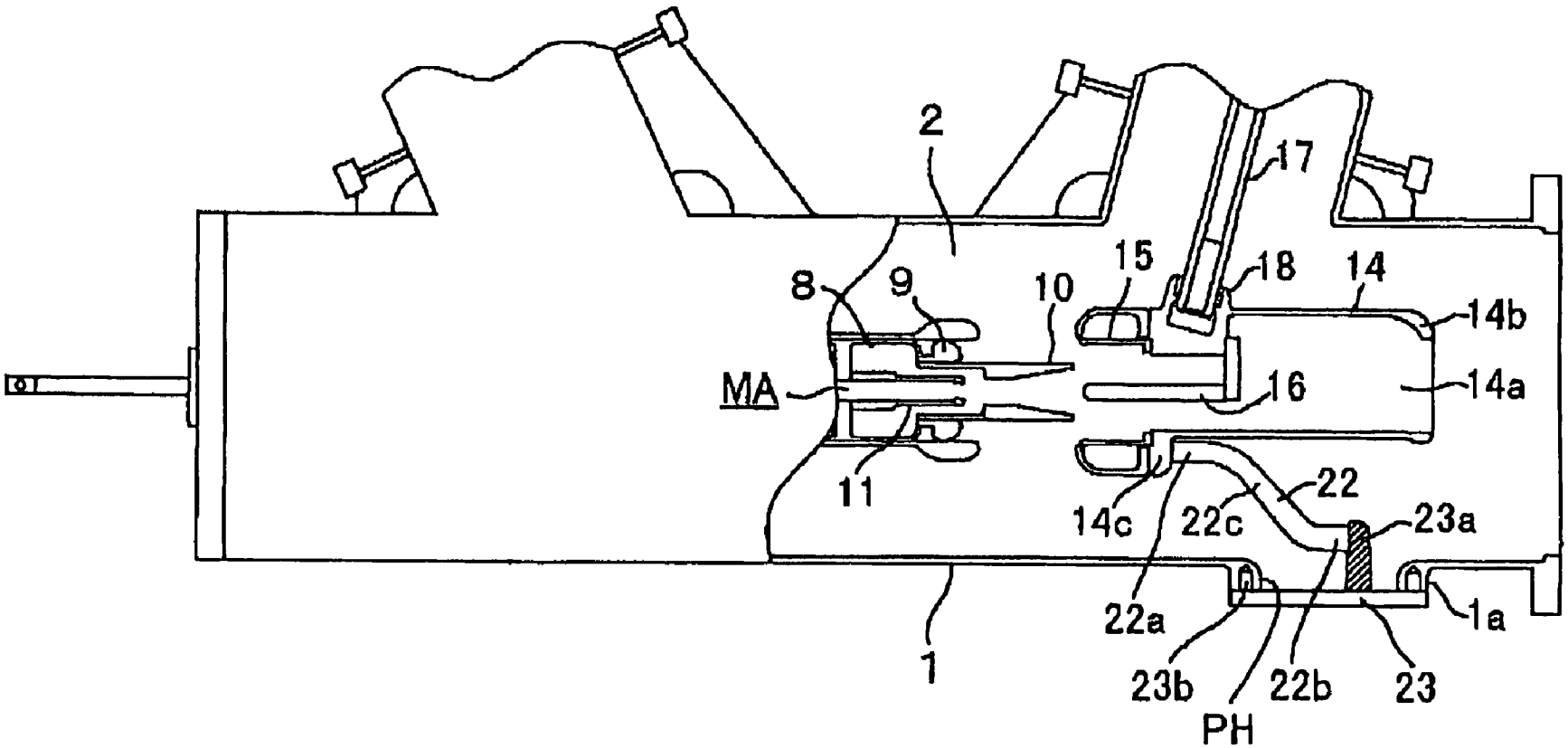
FIG. 1 is a side view showing the construction of an embodiment according to the invention.
Figure 2:
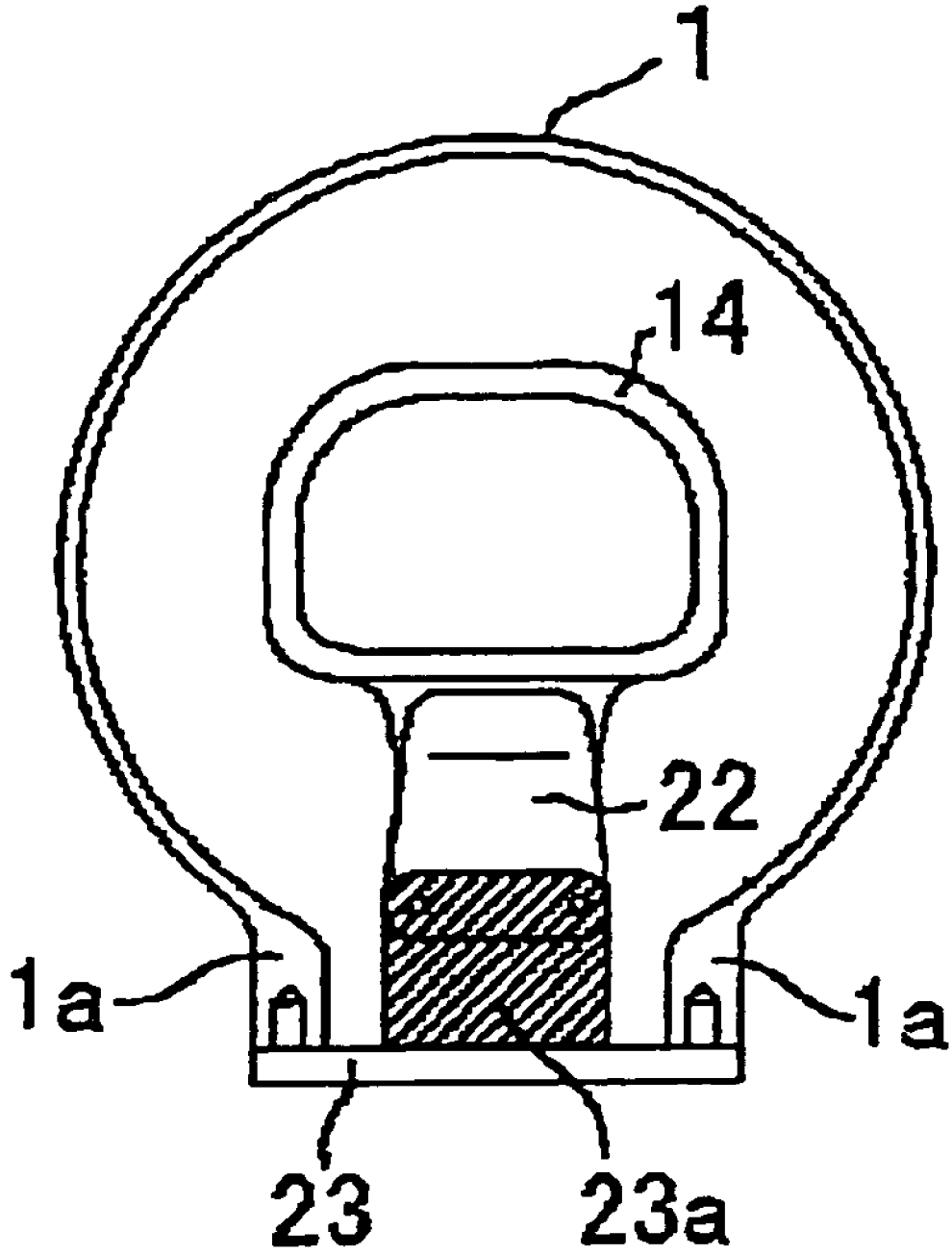
FIG. 2 is a transverse, cross sectional view showing the construction of the embodiment according to the invention.

Embodiment 1 of the invention will be described with reference to the drawings. FIG. 1 is a side view showing the construction of the embodiment according to the invention. FIG. 2 is a transverse, cross sectional view showing the construction of the embodiment according to the invention.

In FIGS. 1 and 2 showing the construction of the embodiment according to the invention, insulating gases 2 such as $SF_6$ gases or the like are charged in a ground metal tank 1 kept at earth potential.

An inside diameter portion of a puffer cylinder 8, which is driven horizontally as shown in FIG. 1, contacts slidably with an outer periphery of a piston (not shown), the puffer cylinder 8 forming a current-carrying conductive path.

A cylindrical-shaped moving contact 9 is mounted to a tip end of the puffer cylinder 8. A cylindrical-shaped insulating nozzle 10 is provided on an inner peripheral side of the moving contact 9 with an interior thereof communicated to an interior of the puffer cylinder 8, and a moving arc contact 11 is arranged inside the insulating nozzle 10.

The puffer cylinder 8, the moving contact 9, the insulating nozzle 10, and the moving arc contact 11 form a moving part MA to be connected to a drive part (not shown) through a rod, which extends through the ground tank 1.

A cylindrical-shaped stationary arc-extinguishing chamber 14 being coaxial with the insulating nozzle 10 is arranged to have its end opposed to the insulating nozzle 10 provided in the moving part MA. The stationary arc-extinguishing chamber 14 is provided with an exhaust port 14*a* and an electric field shield 14*b* in an opening thereof on the other end thereof distant from the insulating nozzle 10.

A stationary contact 15 is provided inside an opening on one end of the cylindrical-shaped stationary arc-extinguishing chamber 14 and a stationary arc contact 16 is provided in the center part of the stationary arc-extinguishing chamber 14.

A high potential side mount 14*c* is provided on an outer peripheral surface portion of the stationary arc-extinguishing chamber 14, and the stationary arc-extinguishing chamber 14 is insulatingly supported by an insulating member 22, a mount portion 22*a* provided on one end of which is mounted to the mount 14*c* and which is mechanically joined to the stationary arc-extinguishing chamber 14. Amount portion 22*b* provided on the other end of the insulating member 22 is mounted to an earth potential side mount 23*a*. The insulating member 22 is arranged toward the stationary contact 15 relative to the exhaust port 14*a* of the stationary arc-extinguishing chamber 14.

The mount portions 22*a* and 22*b* of the insulating member 22 toward the stationary arc-extinguishing chamber 14 and toward the conductive vessel 1, respectively are arranged in parallel to the outer peripheral surface of the stationary arc-extinguishing chamber 14, and an intermediate portion 22*c* of the insulating member is arranged obliquely.

The earth potential side mount 23*a* is provided on an inner surface of a lid plate 23, the lid plate 23 being detachably mounted to an outer surface of a branch pipe flange portion la being a cylindrical-shaped projection, which surrounds an opening PH of the ground tank 1 to project outward, by means of bolts 23.

At the time of assembly of a gas-blast circuit breaker, the earth potential side mount 23*a* is first mounted to the inner surface of the lid plate 23 by welding, etc. before the lid plate 23 is mounted to the cylindrical-shaped projection 1*a* of the ground tank 1, and the lid plate 23 provided with the earth potential side mount 23*a* is detachably mounted to an outer end of the branch pipe flange portion 1*a*, which serves as the cylindrical-shaped projection of the ground tank 1, from outside by means of bolts 23*b*.

The insulating member 22, one end of which is joined to the stationary arc-extinguishing chamber 14 by means of bolt clamping, is joined at the other end thereof to the earth potential side mount 23*a* by means of bolt clamping.

The following construction is proposed by the embodiment of the invention.

In a circuit breaker in which the stationary arc-extinguishing chamber 14 is supported on a ground by an insulator, (1) the insulating member 22 is mounted at an end thereof to the lid plate 23 of the branch pipe flange portion 1*a* provided on the tank 1 side, (2) the insulating member 22 extends lengthwise of the tank 1 along the stationary arc-extinguishing chamber 14, and a mount position on a ground side (tank side) is closer to the stationary side exhaust port 14*a* than a position, in which the insulating member 22 supports the stationary arc-extinguishing chamber 14, (3) a position, in which the insulating member 22 is fixed on a side of the tank 1, is close to the stationary contact 15 than the exhaust port 14*a* of the stationary arc-extinguishing chamber, (4) the insulating member 22 is structured such that the mount portion 22*a* fixed to the arc-extinguishing chamber 14 and the mount portion 22*b* on the side of the tank 1 are substantially parallel to each other and the central portion 22*c* is formed obliquely, (5) the insulating member 22 comprises one or plural members, and (6) the insulating member 22 is mounted to a boss as the earth potential side mount 23*a* fixed to the tank lid plate 23.

With such construction, one end of the insulating member 22, which insulatingly supports the stationary arc-extinguishing chamber 14, is mounted to the lid plate 23 of the branch pipe flange portion 1*a*, whereby there is produced an effect that working of the mount portions is made easy and a long insulation distance to the stationary arc-extinguishing chamber 14 is ensured.

Embodiment 1 of the invention comprises an electrically conductive vessel comprising the ground metal tank 1 charged with insulating gases and kept at earth potential, the stationary arc-extinguishing chamber 14 accommodated in the electrically conductive vessel composed of the ground metal tank 1 and corresponding to the moving part MA to extinguish an arc generated between it and the moving part MA, the insulating member 22 that supports the stationary arc-extinguishing chamber 14 to insulate the same from the earth potential portion, the opening PH provided on the electrically conductive vessel composed of the ground metal tank 1, and the lid body 23 that closes the opening PH provided on the electrically conductive vessel composed of the ground metal tank 1 and is arranged detachably on the opening PH from outside the electrically conductive vessel composed of the ground metal tank 1, and one end of the insulating member 22 is mounted to the mount 23*a* provided on the lid body 23, so that it is possible to obtain a gas-blast circuit breaker, which can ensure a sufficient insulation distance and appropriately and easily perform working of and a mount work of the mount portions of the insulating member.

Also, according to an embodiment of the invention, the cylindrical-shaped projection composed of the branch pipe flange portion 1*a*, which is provided on the electrically conductive vessel composed of the ground metal tank 1 to surround the opening PH to project outward, is provided in addition to the construction described above, and the lid body 23 is detachably mounted to the cylindrical-shaped projection composed of the branch pipe flange portion 1*a* from outside the electrically conductive vessel composed of the ground metal tank 1, so that it is possible to obtain a gas-blast circuit breaker, which can ensure a further long insulation distance and appropriately and easily perform working of and a mount work of the mount portions of the insulating member.

Further, according to an embodiment of the invention, the cylindrical-shaped stationary arc-extinguishing chamber is provided to comprise a stationary contact provided inside an opening on an end thereof and an exhaust port provided on an opening on the other end thereof, and the insulating member is arranged toward the stationary contact relative to the exhaust port of the stationary arc-extinguishing chamber, so that it is possible to obtain a gas-blast circuit breaker, which can ensure a further long insulation distance and appropriately and easily perform working of and a mount work of the mount portions of the insulating member and which can prevent deterioration of insulation of the insulating member.

According to an embodiment of the invention, the mount portion of the insulating member toward the stationary arc-extinguishing chamber and the mount portion thereof toward the conductive vessel are arranged in parallel to the outer peripheral surface of the cylindrical-shaped stationary arc-extinguishing chamber, and the intermediate portion of the insulating member is arranged obliquely, so that it is possible to obtain a gas-blast circuit breaker, which can ensure a further long insulation distance and appropriately and easily perform working of and a mount work of the mount portions of the insulating member and which can appropriately arrange the insulating member in a limited space.

What is claimed is:

1. A gas-blast circuit breaker comprising an electrically conductive vessel charged with insulating gas and kept at ground potential, a stationary arc-extinguishing chamber accommodated in the electrically conductive vessel and corresponding to a moving part to extinguish an arc generated between the stationary arc-extinguishing chamber and the moving part, an insulating member joined at one end thereof to the stationary arc-extinguishing chamber and supporting the stationary arc-extinguishing chamber to insulate the same from a ground potential portion, an opening provided in a tubular sidewall of the electrically conductive vessel, and a lid body that closes the opening arranged detachably on the opening from outside the electrically conductive vessel, wherein the other end of the insulating member is mounted to a mount provided on the lid body.

2. The gas-blast circuit breaker according to claim 1, further comprising a cylindrical-shaped projection provided on the electrically conductive vessel to surround the opening to project outward, wherein the lid body is detachably arranged on the cylindrical-shaped projection from outside the electrically conductive vessel.

3. The gas-blast circuit breaker according to claim 1 wherein the stationary arc-extinguishing chamber is cylindrical-shaped and comprises a stationary contact provided inside an opening on one end thereof and an exhaust port provided on an opening on the other end thereof, and wherein the insulating member is arranged toward the stationary contact with respect to the exhaust port of the stationary arc-extinguishing chamber.

4. The gas-blast circuit breaker according to claim 3, wherein the mount portion of the insulating member toward the stationary arc-extinguishing chamber and the mount portion thereof toward the electrically conductive vessel are arranged in parallel to an outer peripheral surface of the stationary arc-extinguishing chamber, and an intermediate portion of the insulating member is arranged obliquely.

* * * * *